US005683848A

United States Patent [19]

Ong et al.

[11] Patent Number: 5,683,848

[45] Date of Patent: Nov. 4, 1997

[54] ACRYLONITRILE-MODIFIED TONER COMPOSITION AND PROCESSES

[75] Inventors: Beng S. Ong, Mississauga, Canada; Grazyna E. Kmiecik-Lawrynowicz, Fairport, N.Y.; Raj D. Patel, Oakville, Canada; Walter Mychajlowskij, Georgetown, Canada; David J. Sanders, Oakville, Canada; T. Hwee Ng, Mississauga, Canada

[73] Assignee: Xerox Corporation, Stamford, Conn.

[21] Appl. No.: 720,736

[22] Filed: Oct. 2, 1996

[51] Int. Cl.[6] ..... G03G 9/08

[52] U.S. Cl. ..... 430/137; 430/109

[58] Field of Search ..... 430/137, 109, 430/110, 111

[56] References Cited

U.S. PATENT DOCUMENTS

| | | | |
|---|---|---|---|
| 4,983,488 | 1/1991 | Tan et al. | 430/137 |
| 4,996,127 | 2/1991 | Hasegawa et al. | 430/109 |
| 5,290,654 | 3/1994 | Sacripante et al. | 430/137 |
| 5,308,734 | 5/1994 | Sacripante et al. | 430/137 |
| 5,317,060 | 5/1994 | Kukimoto et al. | 525/197 |
| 5,346,797 | 9/1994 | Kmiecik-Lawrynowicz et al. | 430/137 |
| 5,403,693 | 4/1995 | Patel et al. | 430/137 |
| 5,416,166 | 5/1995 | Yoo et al. | 525/186 |
| 5,536,615 | 7/1996 | Hopper et al. | 430/137 |

*Primary Examiner*—George F. Lesmes
*Assistant Examiner*—Cheryl Juska
*Attorney, Agent, or Firm*—E. O. Palazzo

[57] ABSTRACT

A toner comprised of pigment, and an addition polymer resin generated from about 55 to about 80 weight percent of styrene, from about 1 to about 25 weight percent of acrylate, from about 1 to about 20 weight percent of acrylonitrile, and from about 0.5 to about 5 weight percent of acrylic acid.

13 Claims, No Drawings

ACRYLONITRILE-MODIFIED TONER COMPOSITION AND PROCESSES

PENDING APPLICATIONS

Illustrated in copending patent application U.S. Ser. No. 663,570 and U.S. Pat. No. 5,585,215, the disclosures of each being totally incorporated herein by reference, are a toner comprised of pigment and a styrene-isoprene-acrylic acid resin, and wherein the resin is obtained by the emulsion polymerization of from about 75 to about 90 weight percent of styrene, from about 5 to about 25 weight percent of isoprene, and from about 0.5 to about 5 percent of acrylic acid, and a toner comprised of pigment and a styrene-isoprene-acrylic acid resin, and wherein the resin is generated by the emulsion polymerization of from about 75 to about 85 weight percent of styrene, from about 5 to about 20 weight percent of isoprene, from about 1 to about 15 weight percent of acrylate, or from about 1 to about 15 weight percent of methacrylate, and from about 0.5 to about 5 percent of acrylic acid.

BACKGROUND OF THE INVENTION

The present invention is generally directed to toner processes, and more specifically, to aggregation and coalescence processes for the preparation of toner compositions. In embodiments, the present invention is directed to a chemical preparative process for toners without resorting to conventional pulverization and/or classification methods, thus rendering the present process economical, and wherein in embodiments toner compositions with a toner particle size as indicated herein and defined by volume average diameter of from about 1 to about 20, and preferably from 2 to about 10 microns, and a narrow particle distribution as conventionally characterized by GSD (geometric standard deviation) of, for example, less than 1.35, and more specifically, from about 1.15 to 1.25 as measured on the Coulter Counter can be obtained. The resulting toners can be selected for known electrophotographic imaging and printing processes, enabling significant improvement in image quality as manifested by excellent image resolution and color fidelity, and excellent image gloss and fix characteristics. In embodiments, the present invention is directed to a process comprised of high shear blending of an aqueous pigment dispersion containing pigment and an ionic surfactant, and optional additives such as a charge control agent with a latex emulsion derived from emulsion polymerization of styrene, acrylonitrile, acrylate, and acrylic acid in the presence of an ionic surfactant that is of opposite charge polarity to that in the pigment dispersion and an optional nonionic surfactant, and wherein the latex size is in the range of, for example, from about 0.01 micron to about 1 micron in volume average diameter; heating the resulting flocculent mixture with stirring at a temperature of from about 30° C. below to 1° C. below the glass transition temperature (Tg) of the latex resin to form toner sized aggregates comprised of electrostatically bound latex, pigment, and optional additive particles; and subsequently heating the aggregate suspension in the presence of additional anionic surfactant to a temperature of from about 10° C. to about 60° C. above the Tg of the latex resin to effect coalescence or fusion of the constituents of the aggregates to provide integral toner particles, and wherein the toner particle size ranges from about 1 to about 20 microns, and more specifically, from about 2 to 10 microns in volume average diameter, and a GSD of less than about 1.35, and more specifically of from about 1.15 to about 1.25. The amount of each of the ionic surfactants utilized in the process in embodiments is from about 0.01 to about 5 weight percent, while the nonionic surfactant is selected in an amount of from about 0 to about 5 weight percent of the reaction mixture. The size of the aforementioned aggregates is primarily controlled by the temperature at which the aggregation is conducted, and generally, a higher temperature produces larger aggregates, and thus larger final toner particles. With the toner compositions of the present invention, which contain a specific effective acrylonitrile-butyl acrylate-styrene-acrylic acid, significant improvement in toner performance such as superior image fix on various types of paper substrates is attainable.

In another embodiment thereof, the present invention is directed to an economical chemical process comprised of first blending by high shear mixing an aqueous pigment dispersion containing a pigment, such as HELIOGEN BLUE™ or HOSTAPERM PINK™, and a cationic surfactant, such as benzalkonium chloride (SANIZOL B-S50™), with a latex emulsion comprised of suspended low molecular weight latex particles derived from the emulsion polymerization of styrene, acrylat, acrylonitrile, and acrylic acid monomers in the presence of an anionic surfactant, such as sodium dodecylbenzene sulfonate, for example NEOGEN R™ or NEOGEN SC™, and a nonionic surfactant, such as alkyl phenoxy poly(ethyleneoxy)ethanol, for example IGEPAL 897™ or ANTAROX 897™, and which latex has a particle size of from, for example, about 0.01 to about 1.0 micron in volume average diameter as measured by the Brookhaven Nanosizer; heating the resultant flocculent mixture of latex, pigment, optional known toner additive particles and surfactants at a temperature from about 30° C. to about 1° C. below the Tg of the latex resin to form electrostatically bound aggregates ranging in size of from about 2 microns to about 10 microns in volume average diameter as measured by the Coulter Counter; subsequently heating the aggregate suspension at about 10° C. to 60° C. above the Tg of the latex resin in the presence of additional anionic surfactant to convert the aggregates into integral toner particles, followed by cooling, and isolating the toner formed. Toners prepared in accordance with the present invention enable in embodiments the use of lower toner fusing temperatures, such as from about 130° C. to about 170° C., thereby preserving image resolution, and minimizing or preventing image spread, and eliminating or minimizing paper curl while prolonging the life of fuser rolls, especially xerographic rolls, at lower temperatures. These toners are particularly useful for the development of high quality colored images with excellent image fix and excellent gloss, excellent image resolution, and effective color fidelity on a wide array of different paper substrates. For the relatively low molecular weight styrene based resins which are utilized in the toner compositions of the present invention in embodiments, the inclusion of an acrylonitrile moiety in the resin composition in an effective amount is of importance to achieving excellent image fix and gloss characteristics, as well as improving the toner's resistance to frictional and mechanical breakage in development housings.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70are obtained. This process is thus directed to the use of coagulants, such as inorganic magnesium sulfate, which results in the formation of particles with a wide GSD.

Emulsion/aggregation processes for the preparation of toners are illustrated in a number of patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat No. 5,403,693, U.S. Pat. No. 5,418,108, U.S. Pat. No. 5,364,729, and U.S. Pat. No. 5,346,797.

SUMMARY OF THE INVENTION

Examples of objects of the present invention in embodiments thereof include:

It is an object of the present invention to provide toner compositions and processes with many of the advantages illustrated herein.

In another object of the present invention there are provided simple and economical in situ chemical processes for the direct preparation of black and colored toner compositions with a particle size of from, for example, about 1 to 20 microns, and more specifically from about 2 to 10 microns in volume average diameter, and a narrow GSD of less than 1.35, and more specifically from about 1.15 to 1.25 without the need to resort to conventional classification techniques.

In another object of the present invention there are provided simple and economical processes for black and colored robust toner compositions which provide excellent image fix and gloss characteristics on different paper substrates.

A further object of the present invention is the provision of toner compositions the resins of which are derived from the emulsion polymerization of a mixture of styrene, acrylate, acrylonitrile and acrylic acid, and which compositions enable excellent image fix and gloss characteristics ideal for xerographic color applications, and improved crease resistance.

In an associated object of the present invention there are provided toner compositions which are obtained by aggregation and coalescence of latex, pigment and optional additive particles, and wherein the latex is obtained from the emulsion polymerization of a mixture of acrylonitrile, acrylate, styrene, and acrylic acid.

In a further object of the present invention there is provided a chemical process for the preparation of toner compositions by aggregation and coalescence of latex, pigment and optional additive particles, and wherein specific toner particle size ranging from 1 to 20 microns, and more specifically from about 2 to 10 microns in volume average diameter, are precisely achieved through proper control of the temperature at which aggregation is accomplished, and which temperature is generally in the range of from about 30° C. to about 65° C.

In a further object of the present invention there is provided a process for the preparation of toner compositions with excellent pigment dispersion, thus enabling the production of high quality reprographic color images with excellent image color fidelity and excellent image projection efficiency.

In yet another object of the present invention there are provided toner compositions with lower fusing temperature characteristics of about 5° C. to 40° C. lower than those of conventional styrene-based toners.

In a further object of the present invention there are provided toner compositions based on addition polymer resins obtained from emulsion polymerization of a mixture of water, acrylonitrile, acrylate, styrene, and acrylic acid monomers, and which toners when properly fused on paper substrate, afford minimal or no paper curl.

In another object of the present invention there is provided a preparative process by which toner compositions comprising a pigment, optional additives, and a polymer resin of acrylonitrile, acrylate, styrene, and acrylic acid monomers are obtained in high yield of over 90 percent.

Moreover, in another object of the present invention there are provided toner compositions with high image projection efficiency, such as from about 65 to over 90 percent as measured by the Match Scan II spectrophotometer available from Milton-Roy.

Another object of the present invention resides in processes for the preparation of small sized toners having a particle size of from about 2 to about 10 microns in volume average diameter, and a GSD of from about 1.15to 1.25.

These and other objects of the present invention are accomplished in embodiments by the provision of toners and processes thereof. In embodiments of the present invention, there are provided processes for the economical, direct preparation of toner compositions with specific toner resins which enable improved image fix to paper as generally characterized by lower image crease, and excellent image gloss as characterized by high image gloss value, and wherein the toner particle size is in the range of from about 1 to about 20 microns, or more preferably from about 2 to 10 microns in volume average diameter, and which toners possess a narrow GSD of less than 1.35, and preferably of from about 1.15 to about 1.25, thus enabling enhanced image resolution, lower image pile height, and thus eliminating or minimizing undesirable image text feel and paper curl.

In embodiments, the present invention is directed to processes for the preparation of toner compositions which comprises blending, by means of a high shearing device such as a Brinkmann polytron, a sonicator or microfiuidizer, an aqueous pigment dispersion containing water, a pigment or pigments, such as carbon black like REGAL 330®, phthalocyanine, quinacridone or RHODAMINE B™ type, and a cationic surfactant, such as benzalkonium chloride, and optional known charge control additives with a latex emulsion obtained from emulsion polymerization of a mixture of acrylonitrile, acrylate, styrene, and acrylic acid, and which latex emulsion contains an anionic surfactant, such as sodium dodecylbenzene sulfonate, and a nonionic surfactant; heating the resulting flocculent mixture at a temperature from about 30° C. to 1° C. below the Tg of the latex resin to induce formation of toner sized aggregates comprised of latex, pigment, and optional additive particles; effecting coalescence of the aggregates at a temperature of from about 10° C. to about 60° C. above the Tg of the resin in the presence of additional anionic surfactant, wherein the constituents of the aggregates coalesce or fuse together to form integral toner particles; followed by cooling and isolating the resultant toner product by washing with water, and drying by means of an Aromatic fluidized bed dryer, comprised of dryer to provide toners comprised of the aforementioned resin, pigment, and optional charge control additive, and which toners have a particle size of from about 1 to about 20 microns, and more specifically, from about 2 to 10 microns in volume average particle diameter, and a GSD of from about 1.15 to about 1.25 as measured by the Coulter Counter.

Embodiments of the present invention include a process for the preparation of toner compositions comprised of pigment, optional toner additives, and certain important emulsion polymer resins derived from emulsion polymerization of a mixture of acrylonitrile, acrylate, styrene, and acrylic acid monomers, comprising:

(i) preparing, or providing a latex emulsion by emulsion polymerization of acrylonitrile, acrylate, styrene, and acrylic acid in the presence of an anionic surfactant and a nonionic surfactant, and wherein acrylonitrile of 1 to 20 weight percent, acrylate of about 10 to 30 weight percent, styrene of about 55 to 80 weight percent, and acrylic acid of about 0.5 to about 5 weight percent are selected;

(ii) blending the resulting latex emulsion with optional additives and an aqueous pigment dispersion containing a cationic surfactant by means of a high shearing device to provide a flocculent mixture;

(iii) heating the flocculent mixture with gentle stirring at a temperature of from about 30° C. to about 1° C. below the resin Tg to form electrostatically bound aggregates of latex, pigment, and optional additive particles, such as wax, charge control agent, and the like, and wherein the aggregate size is in the range of from about 2 to about 10 microns in volume average diameter, and the aggregate GSD is from about 1.15 to about 1.25;

(iv) heating the aggregate suspension at about 65° C. to about 110° C. in the presence of additional anionic surfactant to convert the aggregates into integral toner particles comprised of a pigment, optional additives, and a polymer resin of acrylontrile, acrylate, styrene, and acrylic acid monomer, followed by cooling; and (v) isolating the toner product by washing, followed by drying, and optionally blending with surface additives.

Also, in embodiments the present invention is directed to processes for the preparation of toner compositions which comprises (i) preparing a pigment mixture by dispersing optional charge control additives and a pigment, such as carbon black like REGAL 330®, HOSTAPERM PINK™, or PV FAST BLUE™ of from about 1 to about 20 percent by weight of toner in an aqueous mixture containing a cationic surfactant such as dialkylbenzene dialkylammonium chloride, for example SANIZOL B-50™ available from Kao, or MIRAPOL™ available from Alkaril Chemicals, utilizing a high shearing device, such as a Brinkman Polytron or IKA homogenizer; (ii) adding the resulting pigment dispersion to a latex emulsion derived from the emulsion polymerization of a mixture of acrylonitrile, acrylate, styrene, and acrylic acid in the presence of an anionic surfactant, such as sodium dodecylsulfate, dodecylbenzene sulfonate or NEOGEN R™, and a nonionic surfactant, such as polyethylene glycol or polyoxyethylene glycol nonyl phenyl ether or IGEPAL 897™ obtained from GAF Chemical Company; (iii) homogenizing the above mixture using a high shearing device, such as a Brinkman Polytron or IKA homogenizer, at a speed of from about 3,000 revolutions per minute to about 10,000 revolutions per minute for a duration of from about 1 minute to about 120 minutes, and heating the resultant mixture at a temperature of from 30° C. below to 1° C. below the Tg of the latex resin while mechanically stirred at a speed of from about 250 to about 500 rpm to effect formation of electrostatically bound aggregates of from about 2 microns to about 10 microns in volume average diameter; (iv) subsequently heating the aggregate mixture at 65° C. to about 110° C. for a duration of about 30 minutes to a few, such as tow or three hours in the presence of additional anionic surfactant in the amount of from about 0.01 percent to about 5 percent by weight to form integral toner particles of from about 2 to about 10 microns in volume average diameter, and a GSD of from about 1.15 to about 1.25 as measured by the Coulter Counter; cooling and (v) isolating the toner particles by washing, filtering and drying, thereby providing toner particles with a toner composition comprised of an acrylonitrile-acrylate-styrene-acrylic acid resin, pigment, and optional charge control additives. Flow additives to improve flow properties may be optionally added to the toner obtained by blending with the toner, which additives include AEROSILS® or silicas, metal oxides like tin, titanium and the like, metal salts of fatty acids like zinc stearate, and which additives each can be present in various effective amounts, such as from about 0.1 to about 5 percent by weight of toner.

Embodiments of the present invention include a toner comprised of pigment, and an addition polymer resin generated from about 55 to about 80 weight percent of styrene, from about 1 to about 25 weight percent of acrylate, from about 1 to about 20 weight percent of acrylonitrile, and from about 0.5 to about 5 weight percent of acrylic acid; a toner comprised of pigment, and a styrene-acrylate-acrylonitrile-acrylic acid resin obtained from the emulsion polymerization of from about 55 to about 80 weight percent of styrene, from about 5 to about 25 weight percent of acrylate, from about 1 to about 20 weight percent of acrylonitrile, and from about 0.5 to about 5 weight percent of acrylic acid, and wherein said resin possesses a weight average molecular weight ($M_w$) of from about 18,000 to about 35,000 and a number average molecular weight ($M_n$) of from about 5,000 to about 10,000, relative to styrene standards; a toner comprised of pigment, and a styrene-acrylate-acrylonitrile-acrylic acid resin derived from emulsion polymerization of from about 65 to about 80 weight percent of styrene, from about 15 to about 25 weight percent of acrylate, from about 1 to about 10 weight percent of acrylonitrile, and from about 0.5 to about 3 weight percent of acrylic acid, and wherein said resin has a weight average molecular weight ($M_w$) of from about 18,000 to about 30,000 and a number average molecular weight ($M_n$) of from about 5,000 to about 10,000, relative to styrene standards; a toner wherein the resin possesses an $M_w$ of from about 20,000 to about 30,000, and an $M_n$ of from about 5,000 to about 8,000, relative to styrene standards; a process for the preparation of toner comprising:

(i) preparing in the presence of an ionic surfactant and an optional nonionic surfactant a latex emulsion generated from the emulsion polymerization of a mixture of from about 55 to about 80 weight percent of styrene, from about 1 to about 25 weight percent of acrylate, from about 1 to about 20 weight percent of acrylonitrile, and from about 0.5 to about 5 weight percent of acrylic acid;

(ii) mixing said latex emulsion by high shear blending with an aqueous pigment dispersion comprised of pigment and an ionic surfactant that is of opposite charge polarity to the ionic surfactant in said latex emulsion;

(iii) heating the resultant flocculent mixture at a temperature that is about 30° C. below to about 10° C. above the Tg of the latex resin to form electrostatically bound toner sized aggregates;

(iv) subsequently heating said aggregate suspension at a temperature of from about 10° C. to about 50° C. above the Tg of the latex resin; and optionally (v) followed by washing, drying, and dry-blending the toner with surface additives; a process for the preparation of toner comprising (i) preparing in the presence of an ionic surfactant and an optional nonionic surfactant a latex emulsion generated from the emulsion polymerization of a mixture of from about 55 to about 80 weight percent of styrene, from about 1 to about 25 weight percent of acrylate, from about 1 to about 20 weight percent of acrylonitrile, and from about 0.5 to about 5 weight percent of acrylic acid;

(ii) mixing said latex emulsion with an aqueous pigment dispersion comprised of pigment and an ionic surfactant that is of an opposite charge polarity to the ionic surfactant in said latex emulsion;

(iii) heating the resultant mixture at a temperature that is about 30° C. below to about 10° C. above the Tg of the latex resin to form aggregates;

(iv) heating said aggregate suspension at a temperature of from about 10° C. to about 50° C. above the Tg of the latex resin; and optionally (v) followed by washing, drying, and dry-blending the toner with surface additives; and a process wherein subsequent to (iv) the toner formed is cooled, and isolated, followed by washing, and drying; and a process for the preparation of toner comprising mixing an aqueous pigment dispersion with a latex emulsion, wherein said pigment dispersion is comprised of pigment and an ionic surfactant that is of opposite charge polarity to the ionic surfactant in said latex emulsion; and wherein said latex emulsion is generated from the emulsion polymerization of a mixture of from about 55 to about 80 weight percent of styrene, from about 1 to about 25 weight percent of acrylate, from about 1 to about 20 weight percent of acrylonitrile, and from about 0.5 to about 5 weight percent of acrylic acid, and which polymerization is accomplished in the presence of an ionic surfactant and an optional nonionic surfactant; heating the resultant mixture at a temperature that is about 30° C. below to about 10° C. above the Tg of the latex resin to form toner aggregates; subsequently heating said aggregates at a temperature of from about 10° C. to about 50° C. above the Tg of the latex resin; and optionally followed by washing, drying, and dry-blending the toner with surface additives.

Of importance with respect to the toner compositions of the present invention is the selection of a acrylonitrile-acrylate-styrene-acrylic acid resin which is obtained from emulsion polymerization of acrylonitrile acrylate, styrene, and acrylic acid in respective effective amounts of about 1 to about 20 weight percent, about 10 to about 30 weight percent, about 55 to about 80 weight percent, and about 0.5 about to 5 weight percent. Illustrative examples of the acrylate monomers utilized in the preparation of acrylonitrile-acrylate-styrene-acrylic acid latex resins for the toner compositions of the present invention include methyl acrylate, ethyl acrylate, propyl acrylate, butyl acrylate, pentyl acrylate, hexyl acrylate. and the like. Effective amounts of the selected resin in the toner compositions of the present invention range from about 80 weight percent to about 98 weight percent of the toner.

Various known colorants or pigments present in the toners in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACK™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™available from Paul Uhlich & Company, Inc., PIGMENT VIOLET 1™, PIGMENT RED 48™, LEMON CHROME YELLOW DCC 1026™, ED. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5acetoacetanilide, and Permanent Yellow FGL. Colored magnetites, such as mixtures of MAPICO BLACK™, and cyan components may also be selected as pigments with the process of the present invention.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference; nitrobenzene sulfonates; TRH a known charge enhancing additive aluminum complex, BONTRON E-84™ and BONTRON E-88™, and other known charge enhancing additives, and the like. Mixtures of charge additives may also be selected.

Surfactants in amounts of, for example, 0.01 to about 15 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example, from about 0 to about 5 percent by weight of total reaction mixture.

Examples of ionic surfactants include anionic and cationic with examples of anionic surfactants being, for example, sodium dodecylsulfate, sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 5 percent by weight, and preferably from about 0.01 to about 3 percent by weight of monomers used to prepare the copolymer resin particles of the emulsion or latex blend.

Examples of the cationic surfactants selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.01 percent to about 5 percent by weight of total reaction mixture. Preferably, the molar ratio of the cationic surfactant used for flocculation to the anionic surfactant used in the latex preparation is in the range of from about 0.5 to 4, and preferably from 0.5 to 2.

Examples of the additional anionic surfactants which are added just before the coalescence step to prevent further growth in aggregate size with increasing temperature include sodium dodecylbenzene sulfonate, sodium dodecylnaphthalene sulfate, dialkyl benzenealkyl sulfates and sulfonates, available from Aldrich, NEOGEN R™, NEOGEN SC™ obtained from Kao and the like. An effective concentration of the surfactant that serves to stabilize the aggregate size during coalescence ranges, for example, from about 0.01 to about 5 percent by weight, and preferably from about 0.01 to about 3 percent by weight of total reaction mixture.

Surface additives that can be added to the toner compositions after washing and drying include, for example, those mentioned herein, such as metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent, which can also be added during the aggregation or coalescence step, the washing or dry blending step wherein additives are mechanically coated onto the surface of the toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods, especially xerographic imaging and printing processes are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention.

EXAMPLE I

An organic phase was prepared by dissolving 4.0 grams of carbon tetrabromide in a mixture of 308.0 grams of styrene, 20.0 grams of acrylonitrile, 72.0 grams of butylacrylate, 12.0 grams of acrylic acid, and 14.0 grams of dodecanethiol. An aqueous phase was prepared by mixing an aqueous solution of 4.0 grams of ammonium persulfate in 100 milliliters of water with 500 milliliters of an aqueous solution of 10.0 grams of anionic surfactant, NEOGEN R™ (which contains 60 weight percent of active sodium dodecyl benzene sulfonate in water), and 8.6 grams of nonionic surfactant, ANTAROX CA 897™ (which contains 70 weight percent of active polyoxyethylene nonyl phenyl ether in water). The organic phase was then added to the aqueous phase, and stirred at room temperature, about 25° C., for 30 minutes. Subsequently, the mixture was heated to 70° C. at a rate of 1° C. per minute, and retained at this temperature for 6 hours. The resulting latex polymer had an $M_w$ of 19,400, an $M_n$ of 5,100, and a mid-point Tg of 57.0° C.

260 Grams of the above latex emulsion and 230 grams of an aqueous pigment dispersion containing 7.5 grams of dispersed BHD 6000 Sunsperse Cyan Pigment (54.4 weight percent of pigment) obtained from Sun Chemicals, and 2.6 grams of cationic surfactant, SANIZOL B™, were simultaneously added to 400 grams of water with high shear stirring by means of a polytron. The mixture was transferred to a 2 liter reaction vessel and heated at a temperature of 52° C. for 1.5 hours before 20 milliliters of 20 percent aqueous NEOGEN R™ solution were added. Subsequently, the mixture was heated to 95° C. and retained there for a period of 4 hours, followed by cooling, and isolating the toner by filtration. The resulting toner product showed a particle size of 6.9 microns in volume average diameter, and a GSD of 1.22 as measured with a Coulter Counter.

Standard fusing properties of the toner compositions of the present invention were evaluated as follows: unfused images of toner on paper with a controlled toner mass per unit area of 1.2 milligrams/cm$^2$ were generated as follows. A suitable electrophotographic developer was generated by mixing from 2 to 10 percent by weight of the above prepared 6.9 micron toner in volume average diameter toner with a suitable electrophotographic carrier, such as, for example, a 90 micron diameter ferrite core, spray coated with 0.5 weight percent of a terpolymer of poly(methyl methacrylate), styrene, and vinyltriethoxysilane, and roll milling the mixture for 10 to 30 minutes to produce a tribocharge of between −5 to −20 microcoulombs per gram of toner as measured with a Faraday Cage. The developer was then introduced into a small electrophotographic copier, such as Mita DC-111, in which the fuser system had been disconnected. Between 20 and 50 unfused images of a test pattern consisting of a 65 millimeter by 65 millimeter square solid area were produced on 8½ by 11 inch sheets of a typical electrophotographic paper such as Xerox Image LX paper.

The unfused images were then fused by feeding them through a hot roll fuser system consisting of a fuser roll and pressure roll with Viton surfaces, both of which were heated to a controlled temperature. Fused images were produced over a range of hot roll fusing temperatures of from about 130° C. to about 210° C. The toner had a gloss, $T(G_{50})$ of 144° C. and an MFT of 136° C. The gloss of the fused images was measured according to TAPPI Standard T480 at a 75° angle of incidence and reflection, using a Novo-Gloss Statistical Glossmeter, Model GL-NG1002S from Paul N. Gardner Company, Inc. The degree of permanence of the fused images was evaluated by the Crease Test. The fused image was folded under a specific weight with the toner image to the inside of the fold. The image was then unfolded and any loose toner wiped from the resulting crease with a cotton swab. The average width of the paper substrate, which shows through the fused toner image in the vicinity of the crease, was measured with a custom built image analysis system.

The fusing performance of a given toner is traditionally judged from the fusing temperatures required to achieve acceptable image gloss and fix. For high quality color applications, an image gloss greater than 50 gloss units is preferred. The minimum fuser temperature required to produce a gloss of 50 is defined as $T(G_{50})$ for a given toner. Similarly, the minimum fuser temperature required to produce a crease value less than the maximum acceptable crease is known as the Minimum Fix Temperature (MFT) for a given toner. In general, it is desirable to have both $T(G_{50})$ and MFT as low as possible such as below 190° C., and preferably below 170° C, in order to minimize the power requirements of the hot roll fuser and prolong its serviceable life.

The toner as prepared in this Example possessed a $T(G_{50})$ of 139° C. and an MFT of 144° C.

EXAMPLE II

An organic phase was prepared by dissolving 4.0 grams of carbon tetrabromide in a mixture of 280.0 grams of styrene, 20.0 grams of acrylonitrile, 100.0 grams of butylacrylate, 8.0 grams of acrylic acid, and 8.0 grams of dodecanethiol. An aqueous phase was prepared by mixing an aqueous solution of 4.0 grams of ammonium persulfate in 100 milliliters of water with 500 milliliters of an aqueous solution of 10.0 grams of anionic surfactant, NEOGEN R™ (which contains 60 weight percent of active sodium dodecyl benzene sulfonate in water) and 8.6 grams of nonionic surfactant, ANTAROX CA 897™ (which contains 70 weight percent of active polyoxyethylene nonyl phenyl ether in water). The organic phase was then added to the aqueous phase, and stirred at room temperature for 30 minutes. The resulting mixture was heated to 70° C. at a rate of 1° C. per minute, and retained at this temperature for 6 hours. The resulting latex polymer displayed an $M_w$ of 23,900, an $M_n$ of 7,900, and a mid-point Tg of 53.7° C.

260 Grams of the above latex emulsion and 230 grams of an aqueous pigment dispersion containing 7.5 grams of dispersed BHD 6000 Sunsperse Cyan Pigment (54.4 weight percent of pigment) obtained from Sun Chemicals, and 2.6 grams of cationic surfactant, SANIZOL B™, were simultaneously added to 400 grams of water with high shear stirring by means of a polytron. The mixture was transferred to a 2 liter reaction vessel and heated at a temperature of 50° C. for 1.0 hour before 20 milliliters of 20 percent aqueous NEOGEN R™ solution were added. Subsequently, the mixture was heated to 95° C. and held there for a period of 3 hours. The resulting toner product after cooling and isolation evidenced a particle size of 7.1 microns in volume average diameter and a GSD of 1.20 as measured with a Coulter Counter.

The toner was evaluated in accordance with the procedure of Example I, and a $T(G_{50})$ of 137° C. and an MFT of 139° C. were obtained.

EXAMPLE III

An organic phase was prepared by dissolving 4.0 grams of carbon tetrabromide in a mixture of 288.0 grams of styrene, 40.0 grams of acrylonitrile, 72.0 grams of butylacrylate, 8.0 grams of acrylic acid, and 8.0 grams of dodecanethiol. An aqueous phase was prepared by mixing an aqueous solution of 4.0 grams of ammonium persulfate in 100 milliliters of water with 500 milliliters of an aqueous solution of 10.0 grams of anionic surfactant, NEOGEN R™ (which contains 60 weight percent of active sodium dodecyl benzene sulfonate in water) and 8.6 grams of nonionic surfactant, ANTAROX CA 897™ (which contains 70 weight percent of active polyoxyethylene nonyl phenyl ether in water). The organic phase was then added to the aqueous phase, and stirred at room temperature for 30 minutes. The resulting mixture was heated to 70° C. at a rate of 1° C. per minute and retained at this temperature for 6 hours. The resulting latex polymer displayed an $M_w$ of 21,300, an $M_n$ of 5,600, and a mid-point Tg of 59.8° C.

260 Grams of the above latex emulsion and 230 grams of an aqueous pigment dispersion containing 7.5 grams of dispersed BHD 6000 Sunsperse Cyan Pigment (54.4 weight percent of pigment) obtained from Sun Chemicals, and 2.6 grams of cationic surfactant, SANIZOL B™, were simultaneously added to 400 grams of water with high shear stirring by means of a polytron. The mixture was transferred to a 2 liter reaction vessel and heated at a temperature of 55° C. for 2.0 hours before 45 milliliters of 20 percent aqueous NEOGEN R™ solution were added. Subsequently, the mixture was heated to 95° C. and held there for a period of 3 hours, followed by cooling to room temperature. The resulting toner product showed a particle size of 7.6 microns and a GSD of 1.24 as measured with a Coulter Counter.

The toner was evaluated in accordance with the procedure of Example I, and a $T(G_{50})$ of 152° C. and an MFT of 165° C. were obtained.

EXAMPLE IV

An organic phase was prepared by dissolving 4.0 grams of carbon tetrabromide in a mixture of 220.0 grams of styrene, 80.0 grams of acrylonitrile, 100 grams of butylacrylate, 8.0 grams of acrylic acid, and 12.0 grams of dodecanethiol. An aqueous phase was prepared by mixing an aqueous solution of 4.0 grams of ammonium persulfate in 100 milliliters of water with 500 milliliters of an aqueous solution of 10.0 grams of anionic surfactant, NEOGEN R™ (which contains 60 weight percent of active sodium dodecyl benzene sulfonate in water) and 8.6 grams of nonionic surfactant, ANTAROX CA 897™ (which contains 70 weight percent of active polyoxyethylene nonyl phenyl ether in water). The organic phase was then added to the aqueous phase, and stirred at room temperature for 30 minutes. The resulting mixture was heated to 70° C. at a rate of 10° C. per minute, and retained at this temperature for 6 hours. The resulting latex polymer displayed an $M_w$ of 22,300, an $M_n$ of 5,800, and a mid-point Tg of 55.8° C.

260 Grams of the above latex emulsion and 230 grams of an aqueous pigment dispersion containing 7.5 grams of dispersed BHD 6000 Sunsperse Cyan Pigment (54.4 weight percent of pigment) obtained from Sun Chemicals, and 2.6 grams of cationic surfactant, SANIZOL B™, were simultaneously added to 400 grams of water with high shear stirring by means of a polytron. The mixture was transferred to a 2 liter reaction vessel and heated at a temperature of 52° C. for 3.0 hours before 30 milliliters of 20 percent aqueous NEOGEN R™ solution were added. Subsequently, the mixture was heated to 95° C. and held there for a period of 3 hours, followed by cooling and isolation or separation of the toner. The resulting toner product showed a particle size of 7.0 microns and a GSD of 1.21 as measured with the Coulter Counter.

The toner was evaluated in accordance with the procedure of Example I, and a $T(G_{50})$ of 142° C. and an MFT of 146° C. were obtained.

EXAMPLE V

An organic phase was prepared by dissolving 4.0 grams of carbon tetrabromide in a mixture of 260.0 grams of styrene, 60.0 grams of acrylonitrile, 80.0 grams of butylacrylate, 8.0 grams of acrylic acid, and 10.0 grams of dodecanethiol. An aqueous phase was prepared by mixing an aqueous solution of 4.0 grams of ammonium persulfate in 100 milliliters of water with 500 milliliters of an aqueous solution of 10.0 grams of anionic surfactant, NEOGEN R™ (which contains 60 weight percent of active sodium dodecyl benzene sulfonate in water) and 8.6 grams of nonionic surfactant, ANTAROX CA 897™ (which contains 70 weight percent of active polyoxyethylene nonyl phenyl ether in water). The organic phase was then added to the aqueous phase, and stirred at room temperature for 30 minutes. The resulting mixture was heated to 70° C. at a rate of 1° C. per minute, and held at this temperature for 6 hours. The resulting latex polymer displayed an $M_w$ of 23,500, an $M_n$ of 6,100, and a mid-point Tg of 56.3° C.

260 Grams of the above latex emulsion and 230 grams of an aqueous pigment dispersion containing 7.5 grams of dispersed BHD 6000 Sunsperse Cyan Pigment (54.4 weight percent of pigment) obtained from Sun Chemicals, and 2.6 grams of cationic surfactant, SANIZOL B™, were simultaneously added to 400 grams of water with high shear stirring by means of a polytron. The mixture was transferred to a 2 liter reaction vessel and heated at a temperature of 54° C. for 3.0 hour before 35 milliliters of 20 percent aqueous NEOGEN R™ solution were added. Subsequently, the mixture was heated to 95° C. and held there for a period of 3 hours, followed by cooling and isolation of the toner. The resulting toner product showed a particle size of 7.2 microns in volume average diameter and a GSD of 1.26 as measured with a Coulter Counter.

The toner was evaluated in accordance with the procedure of Example I, and a $T(G_{50})$ of 139° C. and an MFT of 149° C. were obtained.

Other modifications of the present invention may occur to those of ordinary skill in the art subsequent to a review of the present application and these modifications, including equivalents thereof, are intended to be included within the scope of the present invention.

What is claimed is:

1. A process for the preparation of toner consisting essentially of:

(i) preparing in the presence of an ionic surfactant and an optional nonionic surfactant a latex emulsion generated from the emulsion polymerization of a mixture of from about 55 to about 80 weight percent of styrene, from about 1 to about 25 weight percent of acrylate, from about 1 to about 20 weight percent of acrylonitrile, and from about 0.5 to about 5 weight percent of acrylic acid;

(ii) mixing said latex emulsion by high shear blending with an aqueous pigment dispersion comprised of pigment and an ionic surfactant that is of opposite charge polarity to the ionic surfactant in said latex emulsion;

(iii) heating the resultant flocculent mixture at a temperature that is about 30° C. below to about 10° C. above the Tg of the latex resin to form electrostatically bound toner sized aggregates;

(iv) subsequently heating said aggregate suspension at a temperature of from about 10° C. to about 50° C. above the Tg of the latex resin; and optionally (v) followed by washing, drying, and dry blending the toner with surface additives.

2. A process in accordance with claim 1 wherein the aggregate size, and thus the final toner particle size is from about 1 to about 20 microns in volume average diameter, and wherein the final toner particle size distribution is narrow as defined by GSD of less than about 1.35.

3. A process in accordance with claim 1 wherein acrylonitrile in said emulsion polymerization is present in amounts of about 5 to 10 weight percent.

4. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol, and wherein the ionic surfactant for (i) is selected from the group consisting of sodium dodecyl sulfate, sodium dodecylbenzene sulfate, and sodium dodecylnaphthalene sulfate.

5. A process in accordance with claim 1 wherein the pigment is carbon black, magnetite, cyan, yellow, magenta, or mixtures thereof.

6. A process in accordance with claim 1 wherein the nonionic surfactant concentration is from about 0 to about 5 weight percent; the ionic surfactant for (i) concentration is about 0.01 to about 10 weight percent; and the ionic surfactant for (ii) concentration is about 0.01 to about 10 weight percent of the reaction mixture.

7. A process in accordance with claim 1 wherein subsequent to (iv) the toner formed is cooled, and isolated, followed by washing, drying, and dry blending the toner with surface additives.

8. A process for the preparation of toner comprising mixing an aqueous colorant dispersion with a latex emulsion containing an ionic surfactant, wherein said colorant dispersion is comprised of colorant and an ionic surfactant that is of opposite charge polarity to the ionic surfactant in said latex emulsion; and wherein said latex emulsion is generated from the emulsion polymerization of a mixture of from about 55 to about 80 weight percent of styrene, from about 1 to about 25 weight percent of acrylate, from about 1 to about 20 weight percent of acrylonitrile, and from about 0.5 to about 5 weight percent of acrylic acid, and which polymerization is accomplished in the presence of an ionic surfactant and an optional nonionic surfactant; heating the resultant mixture at a temperature that is about 30° C. below to about 10° C. above the Tg of the latex resin to form toner aggregates; subsequently heating said aggregates at a temperature of from about 10° C. to about 50° C. above the Tg of the latex resin; and optionally followed by washing, drying, and dry-blending the toner with surface additives.

9. A process in accordance with claim 8 wherein the toner formed is cooled and isolated, followed by washing and drying.

10. A process for the preparation of toner consisting of:

(i) preparing in the presence of an ionic surfactant and an optional nonionic surfactant a latex emulsion containing an ionic surfactant generated from the emulsion polymerization of a mixture of from about 55 to about 80 weight percent of styrene, from about 1 to about 25 weight percent of acrylate, from about 1 to about 20 weight percent of acrylonitrile, and from about 0.5 to about 5 weight percent of acrylic acid;

(ii) mixing said latex emulsion by high shear blending with an aqueous colorant dispersion comprised of colorant and an ionic surfactant that is of opposite charge polarity to the ionic surfactant in said latex emulsion;

(iii) heating the resultant flocculent mixture at a temperature that is about 30° C. below to about 10° C. above the Tg of the latex resin to form electrostatically bound toner sized aggregates;

(iv) subsequently heating said aggregate suspension at a temperature of from about 10° C. to about 50° C. above the Tg of the latex resin;

(v) followed by washing, drying, and dry blending the toner with surface additives.

11. A process in accordance with claim 8 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol, and wherein the ionic surfactant for (i) is selected from the group consisting of sodium dodecyl sulfate, sodium dodecylbenzene sulfate, and sodium dodecylnaphthalene sulfate.

12. A process in accordance with claim 8 wherein the colorant is carbon black, magnetite, cyan, yellow, magenta, or mixtures thereof.

13. A process in accordance with claim 8 wherein the nonionic surfactant concentration is from about 0 to about 5 weight percent; the ionic surfactant for (i) concentration is about 0.01 to about 10 weight percent; and the ionic surfactant for (ii) concentration is about 0.01 to about 10 weight percent of the reaction mixture.

* * * * *